US007029096B2

(12) United States Patent
Weijkamp et al.

(10) Patent No.: US 7,029,096 B2
(45) Date of Patent: Apr. 18, 2006

(54) MULTICOLOR INK JET PRINTING METHOD AND PRINTER

(75) Inventors: Clemens T. Weijkamp, Lomm (NL); Franciscus J. H. M. Van Den Beucken, Beringe (NL); Henricus W. C. Douven, Nederweert (NL)

(73) Assignee: Oce-Technologies B.V., Venlo (NL)

( * ) Notice: Subject to any disclaimer, the term of this patent is extended or adjusted under 35 U.S.C. 154(b) by 35 days.

(21) Appl. No.: 10/680,226

(22) Filed: Oct. 8, 2003

(65) Prior Publication Data

US 2004/0160478 A1 Aug. 19, 2004

(30) Foreign Application Priority Data

Oct. 9, 2002 (EP) ..... 02079284

(51) Int. Cl.
*B41J 2/145* (2006.01)
*B41J 2/15* (2006.01)
*B41J 2/21* (2006.01)

(52) U.S. Cl. ..... 347/40; 347/43

(58) Field of Classification Search ..... 347/40–43

See application file for complete search history.

(56) References Cited

U.S. PATENT DOCUMENTS

| | | | | |
|---|---|---|---|---|
| 5,654,744 | A * | 8/1997 | Nicoloff, Jr. et al. | 347/43 |
| 5,975,679 | A | 11/1999 | Nicoloff, Jr. et al. | |
| 6,017,113 | A | 1/2000 | Nicoloff, Jr. et al. | |
| 6,244,688 | B1 * | 6/2001 | Hickman | 347/43 |
| 6,254,218 | B1 * | 7/2001 | Suzuki et al. | 347/43 |
| 6,257,698 | B1 * | 7/2001 | Bloomberg et al. | 347/40 |
| 6,257,699 | B1 * | 7/2001 | Tracy et al. | 347/40 |
| 6,530,647 | B1 * | 3/2003 | Kubota et al. | 347/43 |

FOREIGN PATENT DOCUMENTS

| | | |
|---|---|---|
| EP | 0590 848 A1 | 4/1994 |
| EP | 1 167 045 A1 | 1/2002 |
| WO | WO WO00/58102 A1 | 10/2000 |

* cited by examiner

*Primary Examiner*—Thinh Nguyen
(74) *Attorney, Agent, or Firm*—Birch,Stewart,Kolasch & Birch,LLP

(57) ABSTRACT

A multicolor ink jet printing method which includes the steps of moving a carriage is moved relative to a recording medium in a main scanning direction and a subscanning direction orthogonal to the main scanning direction, printing each color with a different group of nozzle heads mounted on the carriage, wherein at least one color is printed with a larger number of nozzle heads than the other colors, and printing the at least one color with a larger printing resolution in the main scanning direction than the other colors.

14 Claims, 3 Drawing Sheets

| | | | | | |
|---|---|---|---|---|---|
| | | | K1 | | |
| | | K2 | | | |
| | K3 | | | | C1 |
| K4 | | | | C2 | |
| | | | M1 | | |
| | | M2 | | | |
| | | | | | Y1 |
| | | | | Y2 | |

| | | | | | |
|---|---|---|---|---|---|
| | | | C1 | | |
| | | C2 | | | |
| | M1 | | | | K1 |
| M2 | | | | K2 | |
| | | | K3 | | |
| | | K4 | | | |
| | Y1 | | | | K5 |
| Y2 | | | | K6 | |

MULTICOLOR INK JET PRINTING METHOD AND PRINTER

BACKGROUND OF THE INVENTION

This non-provisional application claims priority under 35 U.S.C. § 119(a) on Patent Application No. 02079284.2 filed in Europe on Oct. 9, 2002, which is herein incorporated by reference.

1. Field of the Invention

The present invention relates to a multicolor ink jet printing method, wherein a carriage is moved relative to a recording medium in a main scanning direction and a subscanning direction orthogonal to the main scanning direction, and each color is printed with a different group of nozzle heads mounted on the carriage, and wherein at least one color is printed with a larger number of nozzle heads than the other colors. The present invention further relates to a printer for carrying out the present method.

2. Related Art

A typical multicolor ink jet printer for printing, for example, with the four colors yellow (Y), magenta (M), cyan (C) and black (K), comprises at least four nozzle heads, i.e., at least one for each color. Each nozzle head has a row of nozzles arranged in the subscanning direction. Thus, when the carriage is moved back and forth across the recording medium in the main scanning direction, each nozzle head prints a swath on the recording medium during each pass of the carriage. In a single-pass printing method, the recording medium, e.g. paper, is fed in the subscanning direction by an amount corresponding to the width of the swath after each pass of the carriage. When the nozzle heads are aligned in the main scanning direction, the different color components are superimposed one upon the other during each pass, and the desired hue of the image is obtained by subtractive color composition.

However, a so-called "banding" phenomenon may occur because the order in which the color components are superimposed depends on the direction of movement of the carriage, and a change in this order leads to slight differences in the obtained hue of the printed image, and, as a result, the hue differences are visible in the form of bands or stripes on the printed image. This problem may be overcome by staggering the nozzle heads in the subscanning direction, so that the different color components are printed in different passes of the carriage and the order in which the colors are superimposed will always be the same, irrespective of the direction of movement of the carriage.

A similar banding phenomenon may also occur when two or more nozzle heads for the same color, e.g. black, are staggered in the subscanning direction in order to increase the printing speed. In this case, banding is due to minor differences in the properties of the different nozzle heads, e.g. differences in the optical densities obtained therefrom. This phenomenon can be mitigated by employing a multi-pass printing method. In a two-pass mode, for example, each printhead prints only every second pixel in each line in a first pass, and the gaps are filled-in by the second nozzle head in the subsequent pass. As a result, the pixel patterns produced by the two nozzle heads are interleaved, and the differences in the properties of the nozzle heads are smoothened out, so that a high image quality is achieved, although at the cost of reduced production.

U.S. Pat. No. 6,257,699 discloses a printing method and a printer of the type indicated above. The printer has three staggered nozzle heads for the colors yellow, magenta and cyan, and another group of three nozzle heads for black. The nozzle heads for black are mounted on the carriage in reverse orientation as compared to the other three nozzle heads and are also staggered in the subscanning direction, such that the staggered rows of nozzle heads overlap in the subscanning direction and one of the nozzle heads for black is aligned with the nozzle head for cyan in the main scanning direction. This printer can be operated in different print modes, including (a) a multi-pass color printing mode, wherein only one of the three black nozzle heads is used in combination with the nozzle heads for the other three colors, (b) a single-pass black and white printing mode, wherein all three black nozzle heads are used and the other nozzle heads are disabled, and (c) a mixed mode, in which black is printed in a multi-pass mode while the other colors are printed in a single pass mode.

WO-A-00/58102 discloses a printer having four nozzle heads for the colors yellow, magenta, cyan and black aligned in main scanning direction and one additional nozzle head for black which is offset from the other nozzle heads in the subscanning direction. The two black nozzle heads are used to speed-up black and white printing. When printing with all four colors, only the offset black nozzle head is used, so that black is printed in another pass than the other three colors. The purpose of this measure is to reduce smears by providing a larger time delay between the time at which a pixel is printed in yellow, magenta and/or cyan and the time at which a black dot is superimposed on this pixel.

SUMMARY OF THE INVENTION

It is an object of the present invention to provide a printing method and printer capable of achieving an improved quality of color images without causing a substantial loss in production.

According to the invention, this object is achieved by a method of the type indicated above, wherein at least one color is printed with a larger printing resolution in a main scanning direction than the other colors.

The invention is based on the observation that the optimal resolution for a color image, especially in main scanning direction, may be different for different colors, especially for yellow, magenta and cyan on the one hand and for black on the other hand. One of the reasons is that the human eye itself has a higher resolution for black and white contrast than for color perception. Another important reason is that, in typical ink systems for color ink jet printers, the black ink has a higher surface tension than the inks of the other colors and, as a result, a black ink droplet forms only a relative small dot on the recording medium, e.g. a film of synthetic resin, whereas ink droplets in the other colors tend to spread out on the surface of the recording medium and form a larger dot, even though the volumes of the ink droplets are all the same. As a result, a high resolution which would be optimal for black is not necessarily optimal for the other colors as well, due to the larger dot size.

According to the present invention, the nozzle heads for one color, e.g. black, which are present in a larger number than the nozzle heads for the other colors are used for increasing the resolution for the black color component, whereas a smaller resolution is used for the other components in one and the same color printing operation. As a result, borderlines between black image areas and white or colored image areas, to which the human eye is particularly sensitive, can be printed smoothly, due to the high resolution, whereas the smaller resolution of the other color components is hardly perceptible to the human eye and, in addition, is adapted to the larger dot size of the colored inks.

Accordingly, in one aspect, the present invention provides a multicolor ink jet printer comprising a carriage adapted to travel relative to a recording medium in a main scanning direction and a subscanning direction orthogonal to the main scanning direction, with a plurality of groups of nozzle heads mounted on the carriage, wherein the groups are assigned to different colors and at least one group (e.g. the one for black) comprises a larger number of nozzle heads than the other groups, and wherein a color print mode is implemented in which the printing resolution in the main scanning direction is larger for the color printed with said one group than for the other colors.

In a preferred embodiment, the nozzle heads of all groups are adapted to print with the same resolution (e.g. 600 dpi) in the subscanning direction. Then, in the color print mode using differential resolution, the resolution in the main scanning direction will also be 600 dpi for black but only a smaller resolution, e.g. 300 dpi, is used for the other colors.

Of course, the printer is also capable of operating in another print mode, single-pass or multi-pass, with maximum resolution (e.g. 600 dpi) in both the main scanning direction and subscanning direction. Conversely, it is possible to use the smaller resolution (300 dpi) not only for yellow, magenta and cyan but also for black. In black and white printing, multi-pass printing is possible to reduce the black and white banding phenomenon.

In a preferred embodiment, not only the black printheads but also the other printheads are staggered in the subscanning direction, so that the order of superposition of the color components is always the same and banding due to hue differences is avoided.

In a particularly preferred embodiment, there are provided at least three, preferably four, nozzle heads in one group (for black) and two nozzle heads in each of the other groups. Thus, at least two nozzle heads are provided for each color, so that high production printing is possible. Nevertheless, by using a staggered arrangement of the nozzle heads in overlapping rows, it is possible to integrate the comparatively large total number of nozzle heads in a relatively compact area of the carriage.

Thus, in another aspect, the invention also provides a multicolor ink jet printer comprising a carriage adapted to travel relative to a recording medium in a main scanning direction and a subscanning direction orthogonal to the main scanning direction, and a plurality of groups of nozzle heads are mounted on the carriage, wherein the groups are assigned to different colors, wherein at least one group comprises at least three nozzle heads and each of the other groups comprises at least two nozzle heads, the nozzle heads of all the groups being staggered in at least three lines perpendicular to the main scanning direction, such that the lines mutually overlap in the subscanning direction.

Preferably, said one group comprises four nozzle heads arranged in one of said slanting lines, and at least one of these nozzle heads is offset relative to each of the other nozzle heads in the subscanning direction. Thus, at least one nozzle head can then be used for bi-directional full color printing without any changes in the print order.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
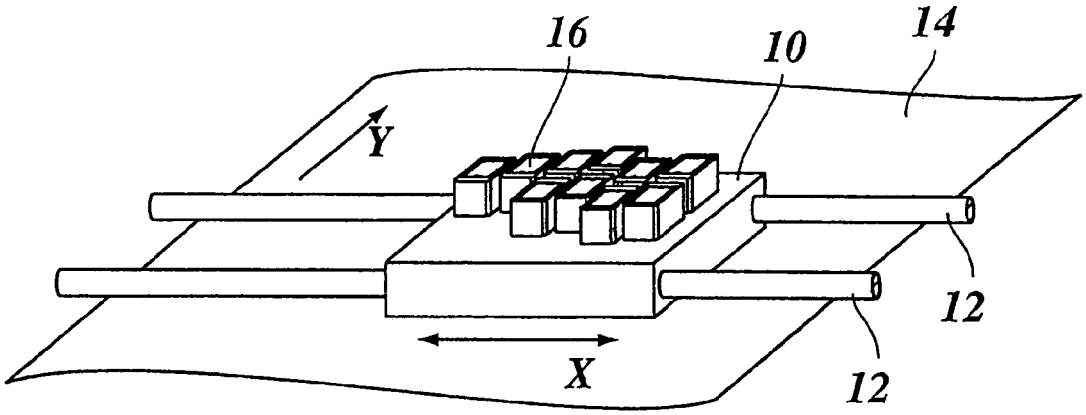
FIG. 1 is a perspective view of a carriage of an ink jet printer according to the present invention.

As is shown in FIG. 1, a multicolor ink jet printer comprises a carriage 10 which is guided on guide rods 12 and, as is known per-se, is driven by a drive mechanism (not shown) to travel along the guide rods 12 in a main scanning direction X relative to a recording medium 14. The recording medium 14 is fed by feeding means (not shown) in a subscanning direction Y which is orthogonal to the main scanning direction X.

A number (10 in this example) of nozzle heads 16 are mounted on the carriage 10 and are arranged in a specific configuration, as will be explained in conjunction with FIG. 2. Each nozzle head 16 is formed integrally with an ink cartridge which is the only part of the nozzle head that is visible in FIG. 1. On the bottom side of the ink cartridge and on the bottom side of the carriage 10, i.e. facing the recording medium 14, each nozzle head 16 has at least one row of nozzles and an associated drive system which may for example be formed by piezoelectric actuators and is configured to cause the individual nozzles to expel ink droplets at appropriate timings in accordance with image information of the image to be printed.

Figure 2:
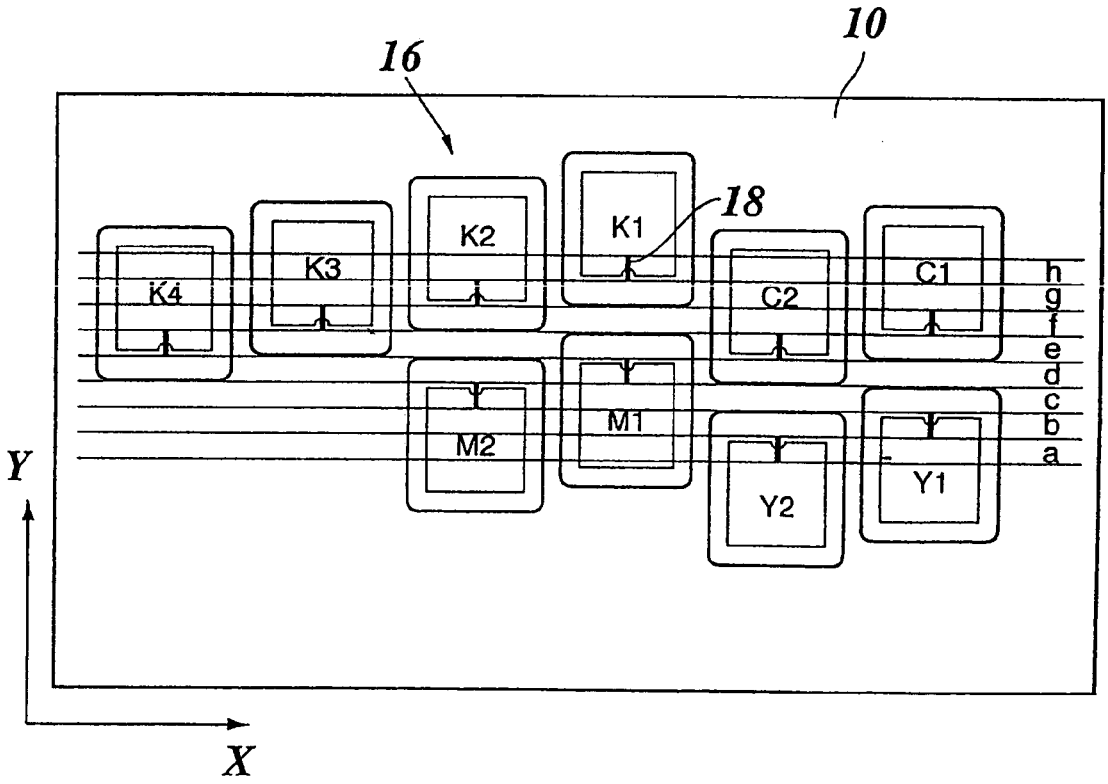
FIG. 2 is a top view of the carriage shown in FIG. 1.

As is shown in FIG. 2, the nozzle heads, which are designated in general by the reference numeral 16, comprise a group of four nozzle heads K1–K4 for black ink, a group of two nozzle heads C1, C2 for cyan, a group of two nozzle heads M1, M2 for magenta and a group of two nozzle heads Y1, Y2 for yellow. The position, orientation and length of the nozzle rows 18 of each nozzle head 16 has been indicated in FIG. 2 by bold vertical lines. It can be seen that the individual nozzle rows 18 of the nozzle heads 16 are offset from one another in the subscanning direction Y by a distance corresponding to their length, so that, when the carriage 10 moves in the main scanning direction Y, the nozzle rows 18 sweep over adjacent swaths a–h. By way of example, it may be assumed that the nozzle heads 16 have a resolution of 600 dpi in the subscanning direction, and each nozzle row 18 has sufficient nozzles to print 192 lines of image dots simultaneously, said 192 lines forming one of the swaths a–h having a width of 8,128 mm.

The nozzle heads K1–K4 forming the group of black nozzle heads are arranged on a straight line which is slanting relative to the main scanning direction X, so that their nozzle rows 18 are appropriately staggered in the subscanning direction Y. Similarly, the nozzle heads C1, C2, M1 and M2 of two other groups form another slanting line in parallel to the first slanting line and overlapping therewith in the subscanning direction, so that the positions of nozzle heads M1, M2 in the direction X coincide with those of the nozzle heads K1 and K2, respectively. Moreover, the positions of the nozzle rows 18 of the nozzle heads C1 and C2 in the main scanning direction X coincide with those of the nozzle rows 18 of the nozzle heads K3 and K4, respectively. It will further be observed that the orientation of the nozzle heads M1 and M2 is inverted relative to those of the nozzle heads K1 and K2. This is necessary in order for the nozzle rows of the nozzle heads C1, C2, M1 and M2 to be arranged on a straight slanting line, irrespective of the comparatively large size of the footprints of the ink cartridges of the nozzle heads and the off-center positions of the nozzle rows 18 relative to the ink cartridges. Similarly, the nozzle heads Y1 and Y2 forming the fourth group are disposed in inverted orientation, so that their nozzle rows 18 form another (short) slanting line and are aligned in the subscanning direction with the nozzle rows of the nozzle heads C1 and C2. It should be noted however that the nozzle rows 18 of the nozzle heads C1, C2, M1, M2, Y1 and Y2 for the colors cyan, magenta and yellow do not overlap in the main scanning direction. This can be seen more clearly in FIG. 3 in which the positions of the various nozzle heads have been shown in diagrammatic form.

The operation of the printer will now be explained with reference to FIG. 2. In a first pass of the carriage 10, either in the positive or negative X-direction, the nozzle heads Y1 and Y2 will print a yellow sub-image or color component of an image to be printed on the swaths a and b. At the end of this pass, the recording medium 14 will be fed in the subscanning direction Y by the width of the two swaths a, b, i.e. by a distance of 16,256 mm. Then, in the next pass, with the carriage 10 moving in opposite direction, the nozzle heads M1 and M2 will print a magenta sub-image on the same swaths a and b, so that each magenta ink dot will overlay a yellow dot that may have been printed at that position in the preceding pass, thereby creating a mixed color. The recording medium is again fed by the same distance, and in the next pass, a cyan sub-image is superimposed by means of the nozzle heads C1 and C2. In a print mode with a resolution of 600×600 dpi for each of the four colors, the nozzle heads K3 and K4 are kept inoperative. At the end of this pass, the recording medium is fed once again, and in a fourth pass, a black sub-image is superimposed by means of the nozzle heads K1 and K2. Of course, when the second pass is performed, the nozzle heads Y1 and Y2 will simultaneously print a yellow sub-image on the subsequent two swaths. In the third pass, the nozzle heads Y1, Y2, M1 and M2 will operate simultaneously with the nozzle heads C1 and C2, and so on.

The nozzle heads K3 and K4 are used for a print mode in which the resolution for the color components yellow, magenta and cyan is 300×600 dpi, i.e. only 300 dpi in the main scanning direction X but 600 dpi in the subscanning direction Y, whereas the resolution for the black sub-image is 600×600 dpi. In this mode, the frequency with which the nozzles of the individual nozzle heads are fired is only one-half the frequency that has been used in the previously described 600×600 dpi mode. The timings at which the nozzles of the nozzle heads K3 and K4 are fired are shifted relative to the timings of the nozzle heads C1 and C2, so that the black ink dots are positioned in the gaps between the cyan dots. In the fourth pass, the nozzles of the nozzle heads K1 and K2 are fired at such timings that the black ink dots produced thereby are superimposed on the cyan ink dots formed with the nozzle heads C1 and C2 and hence in the gaps between the dots formed by the nozzle heads K3 and K4. Thus, for the black sub-image, the full resolution of 600 dpi in the main scanning direction X is achieved in two passes.

In black and white printing, a two-pass mode is achieved by firing the nozzle heads K1, K2, K3, K4 in the same way as described above, with the only difference that the nozzle heads C1, C2, M1, M2, and Y1, Y2 are kept inoperative.

Another possible print mode for black and white is a high speed or draft mode in which the resolution is also 600×600 dpi, but the nozzle heads K1–K4 are operated in a single-pass mode. Then the printing speed is approximately twice as high as in the two-pass mode, but the image quality may be lower because of the banding produced by the four nozzle heads K1–K4.

Conversely, a very high image quality without any banding may be achieved by employing a four-pass mode in black and white. In this mode, the nozzle head K4 will only print every fourth pixel in the first pass, and the remaining pixels will be successively filled-in by the other nozzle heads K3, K2 and K1 in the subsequent passes.

In order to suppress banding produced by the two nozzle heads provided for each color component, it is also possible to employ a full-color two pass mode with a resolution of 600×600 dpi. In this mode, the recording medium is advanced only by the width of a single swath, i.e. 8,128 mm after each pass, so that the nozzle head Y1 will print on the same swath as the nozzle head Y2, and so on. The nozzle heads K3 and K4 are not used in this mode.

In yet another mode, the resolution is again 600×600 dpi for black and 300×600 dpi for the other colors, with four-pass printing being employed for black and two-pass printing for the other three colors.

It will thus be appreciated that the printer can be operated in a large variety of different modes in order to comply with different quality requirements. In general, the time required for printing an image of a given size will increase with increasing quality. However, the mixed modes employing a resolution of 600×600 dpi for black (two-pass printing or four-pass printing) and 300×600 dpi for the other colors (single-pass or two-pass printing) permit a printing quality which is significantly higher than the quality achieved in a corresponding 300×300 dpi mode which would require the same printing time (with the nozzle heads K3, K4 being inoperative).

Figures 3, 4, 5:
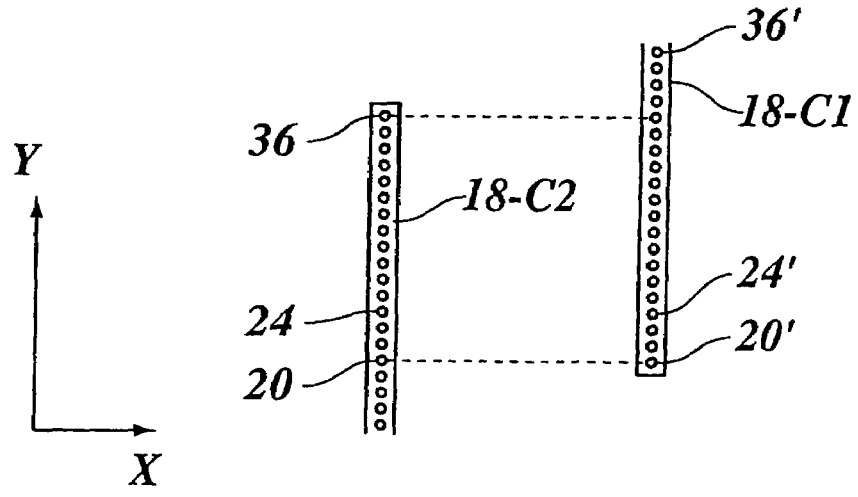
FIG. 3 is a diagram illustrating the arrangement of nozzle heads on the carriage as shown in FIG. 2.
FIG. 4 is a diagram illustrating a modified arrangement of nozzle heads on the carriage.
FIG. 5 is a diagram explaining an overlap between rows of nozzles of adjacent nozzle heads.

In addition, the arrangement of the nozzle heads 16 as shown in FIGS. 2 and 3 permits a compact construction of the carriage 10 in spite of the space requirements for the ink cartridges of the nozzle heads.

FIG. 4 illustrates a modified embodiment employing a group of six nozzle heads K1–K6 for black and two nozzle heads for each of the other colors. This embodiment permits one-pass to six-pass printing for black and white. In full-color printing, it permits a resolution of 600×600 dpi or 300×300 dpi in a single-pass mode or a two-pass mode with the nozzle heads K3, K4 for black and the nozzle heads C1, C2, M1, M2 and Y2, Y2 for the other colors. Since the nozzle heads K3, K4 do not coincide with any of the other nozzle heads, as seen in main scanning direction X, the print order will be independent of the direction of movement of the carriage.

In addition, the following mixed modes are possible for example:

a) a resolution of 600×600 dpi for black and 200×600 dpi for the other colors:
   a1) a three-pass mode for black and a single-pass mode for the other colors.
   a2) a six-pass mode for black and a two-pass mode for the other colors
b) a resolution of 600×600 dpi for black and 300×600 dpi for the other colors:
   b1) a two-pass mode for black (using only four of the six nozzle heads) and a single-pass mode for the other colors.
   b2) a four-pass mode for black (using only four of the six nozzle heads) and a two-pass mode for the other colors.

In the arrangement shown in FIG. 4, the orientation of the nozzle heads K1 and K2 would be inverted relative to those of the nozzle heads K3, K4, Y1 and Y2, in order to avoid interference with the ink cartridges of the nozzle heads K5 and K6. In general, a compact arrangement of the nozzle heads is possible as long as, in any position in X-direction, not more than two of the slanting lines defined by the nozzle rows are overlapping.

When, in the above embodiments, the single-pass mode is used for the colors yellow, magenta and cyan, a minor banding might be visible because adjacent swaths in one color component are printed with different printheads. In order to mitigate this effect, the nozzle row 18 of the nozzle heads in the proposed embodiments each comprise 208 individual nozzles, i.e. 16 nozzles more than the 192 nozzles actually needed, and the nozzle rows are arranged with an overlap of 16 nozzles in the subscanning direction Y, as is shown in FIG. 5. As an example, FIG. 5 shows the bottom end of the nozzle row 18-C1 of the nozzle head C1 in FIG. 2 and the top end of the nozzle row 18-C2 of the nozzle head C2. In the overlapping area of 16 nozzles, the pixels of a given line can be printed with either one of two nozzles. For example, nozzle 20 can print the same pixel line as nozzle 20'.

When, for example, a plain area filled with the color cyan has to be printed, the nozzle 20 will omit every 16th pixel in the line, and the missing pixel will be printed with the nozzle 20'. Similarly, nozzle 24 will omit every 12th pixel in the line, and the missing pixels will be printed with nozzle 24'. Finally, the last nozzle of the row 18-C2, nozzle 36, will print only one pixel in the line, and all the other pixels will be printed by nozzle 36'. In this way, the image printed with the nozzle line 18-C2 is gradually merged with the image printed by the nozzle line 18-C1, so that any differences between the two nozzle heads C1 and C2 are smoothened out. The same holds true for the borders between the nozzle rows of the other pairs of nozzle heads such as Y1, Y2 and M1, M2, and as well for the borders between the four black nozzle heads K1–K4.

In order to avoid artefacts at the transition between adjacent nozzle rows 18, it is important that the nozzle heads 16 are precisely adjusted in the subscanning direction Y. To this end, electronic adjusting means may be used, as is generally known in the art.

The effect of the mixed mode with a resolution of 600×660 dpi for black and 300×600 dpi for the other colors will now be explained by reference to FIGS. 6 and 7.

Figure 6:
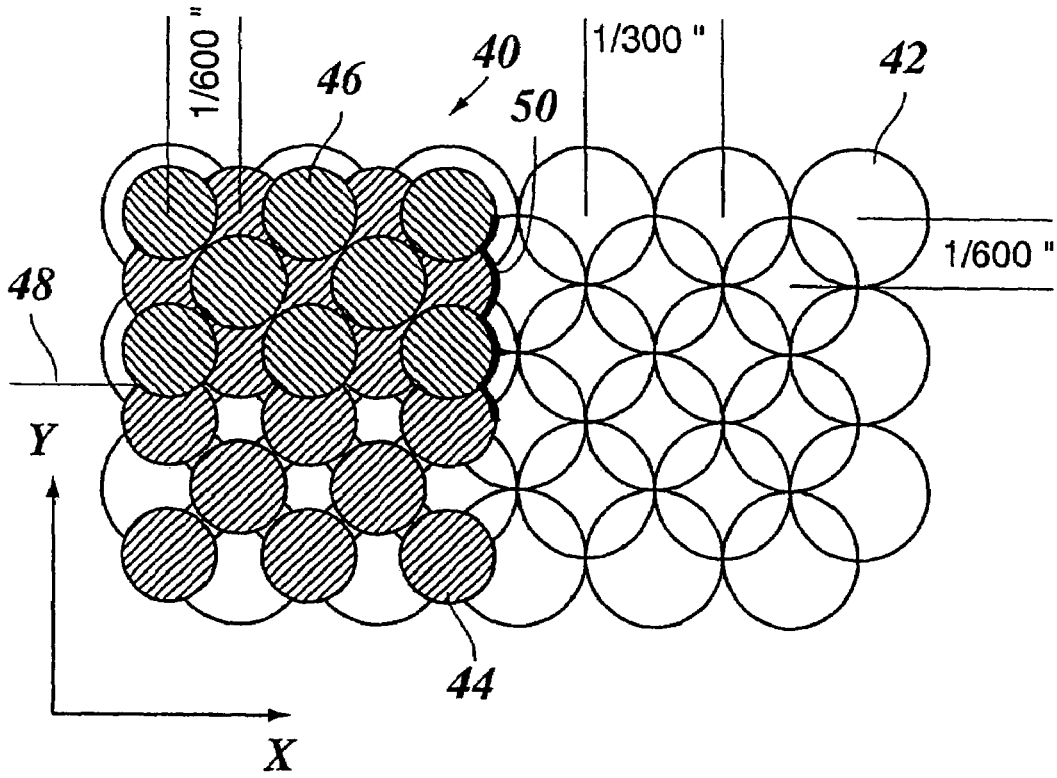
FIG. 6 is a diagram illustrating an arrangement of image dots in an image area printed during a first pass of the carriage.

FIG. 6 shows a pattern of pixels or ink dots corresponding to an image area solidly filled with cyan and superimposed by a vertical black line 40. The cyan ink dots 42 are represented by non-filled circles which have a comparatively large diameter, due to the comparatively low surface tension of cyan ink. The center-to-center distance between adjacent ink dots 42 in the main scanning direction X is 1/300", corresponding to the resolution of 300 dpi, and the corresponding distance in the subscanning direction Y is 1/600". The dots in adjacent lines are shifted relative to one another by 1/600", so that the ink dots overlap and the image area is completely covered with ink, without leaving any voids.

In FIG. 6, it is assumed that the carriage 10 has moved in a positive X-direction while printing the shown part of the image. Thus, the cyan image dots 42 have been printed first by the nozzle head C1, and the black dots 44, 46 forming the black line 40 are printed on the cyan background. The dots 44, 46 have a smaller diameter, due to the higher surface tension of black ink, and are printed with a resolution of 600×600 dpi. The dots 44 have been printed with the nozzle head K3 in FIG. 2, and the dots 46 have been printed with the nozzle head K2. A horizontal line 48 indicates the border between the upper portion of the black line 40, for which the two-pass black printing has been completed, and the lower portion for which only the first pass has been performed. The dots 46 are shown to overlay the dots 44.

It can be seen that the high resolution obtained by two-pass printing in black gives a smooth edge of the black line 40, as has been highlighted at 50.

Figure 7:
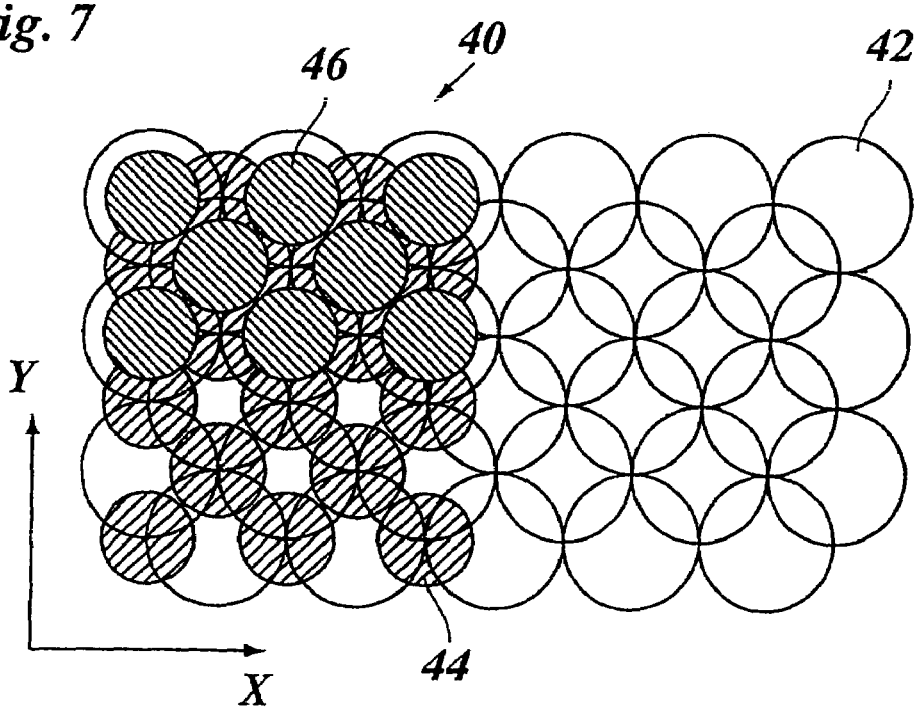
FIG. 7 is a diagram illustrating the arrangement of image dots in an image area printed during a return pass of the carriage.

FIG. 7 illustrates a situation analogous to the one shown in FIG. 6 for the case where the carriage 10 has moved in the opposite direction, i.e. in the -X-direction. In this case, the dots 44 are printed by the nozzle head K3 before the cyan dots 42 are printed by the nozzle head C1. As a result, FIG. 7 shows the dots 44 on top of the dots 42. The dots 46 are printed last and therefore form a top layer.

The fact that the order in which the dots 42 and 44 are printed in FIG. 7 is reversed in comparison to the order in which they are printed in FIG. 6, may give rise to minor changes in the color hue of the final image. However, these differences will hardly be visible for the following reasons:

1. The reversed print order applies only for one half of the black dot, i.e. only to the dots 44 and not to the dots 46.
2. The color cyan printed with the nozzle heads C1 and C2 which are aligned with the black nozzle heads K3 and K4 is relatively dark, so that the dots 42 and the dots 44 have a similar optical density and the reversal of the print order will not cause a significant effect.
3. Although the ink dots have been shown as circles in the drawings, it will be understood that the optical density decreases from the center towards the periphery. As can be seen in FIG. 7, the dots 44 are printed in the gaps between the dots 42 and overlap only with the faint peripheral portions of the dots 42. This also helps to reduce the effects of the reversal of the print order. In contrast, the dots 46 are disposed centrally on the dots 42, but the dots 46 are, in any case, the last ones to be printed, so that there is no reversal in the print order.

Thus, although the cyan nozzle heads C1 and C2 are aligned with the black nozzle heads K3 and K4 in FIG. 1, so that a compact construction of the carriage 10 is achieved, the image quality will not significantly be impaired by the reversal of the print order.

In the 600×600 dpi mode for all colors, there will be no reversal in the print order, anyway, because the nozzle heads K3 and K4 are not used.

Similarly, in the embodiment shown in FIG. 4, there will be no reversal in the print order when only the nozzle heads K3 and K4 are used.

The invention being thus described, it will be obvious that the same may be varied in may ways. Such variations are not to be regarded as a departure from the spirit and scope of the invention, and all such modifications as would be obvious to one skilled in the art are intended to be including within the scope of the following claims.

What is claimed is:

1. A multicolor ink jet printing method which comprises:

moving a carriage relative to a recording medium in a main scanning direction and in a subscanning direction orthogonal to the main scanning direction, printing each color with a different group of nozzle heads mounted on the carriage, printing at least one color with a larger number of nozzle heads than the other colors, and printing said at least one color with a larger printing resolution in the main scanning direction than the other colors.

2. The method according to claim 1, wherein the at least one color is black and the other colors are yellow, magenta and cyan.

3. The method according to claim 2, wherein the colors yellow, magenta and cyan are printed in subsequent bi-directional passes of the carriage, a portion of the black image is printed in the same pass as cyan, and a remaining portion of the black image is printed in a subsequent pass.

4. The method according to claim 1 or 2, wherein black ink dots printed in the same pass as cyan ink dots are printed in the gaps between adjacent cyan ink dots.

5. The method according to claim 1, wherein the liquid ink used for printing said at least one color has a higher surface tension than the ink used for printing the other colors.

6. A multicolor ink jet printer comprising:

a carriage adapted to travel relative to a recording medium in a main scanning direction and a subscanning direction orthogonal to the main scanning direction, and a plurality of groups of nozzle heads mounted on the carriage, wherein each of the groups are assigned to different colors and at least one of the groups comprises a larger number of nozzle heads than the other groups, wherein means are provided for implementing a color print mode in which the printing resolution in the main scanning direction is larger for the color printed with said one group than for the other colors.

7. The multicolor ink jet printer according to claim 6, wherein the nozzle heads for different colors are staggered in the subscanning direction.

8. The multicolor ink jet printer according to claim 7, wherein the nozzle heads are arranged in at least three straight lines that are perpendicular to the main scanning direction and overlap one another in the subscanning direction.

9. The multicolor ink jet printer according to claim 8, wherein the group which has the larger number of nozzle heads than the other groups comprises at least one nozzle head which is offset relative to all the other nozzle heads in the subscanning direction.

10. The multicolor ink jet printer according to claim 8, wherein the group which has the larger number of nozzle heads comprises at least one nozzle head which is aligned with a nozzle head of another group in the main scanning direction.

11. The multicolor ink jet printer according to claim 8, wherein the lines of nozzle heads are arranged such that not more than two nozzle heads are disposed at the same position in the main scanning direction.

12. The multicolor ink jet printer according to claim 6, wherein each group comprises at least two nozzle heads which are staggered in the subscanning direction.

13. The multicolor ink jet printer according to claim 6, wherein each nozzle head is integrated in an ink cartridge and has a nozzle row offset from the center of the ink cartridge, when viewed in the direction in which the ink is jetted-out, and wherein the nozzle heads are mounted on the carriage in two different orientations, rotated relative to one another by 180°.

14. A multicolor ink jet printer comprising:

a carriage adapted to travel relative to a recording medium in a main scanning direction and a subscanning direction orthogonal to the main scanning direction, and a plurality of groups of nozzle heads mounted on the carriage, wherein each of the groups are assigned to different colors, wherein at least one group comprises at least three nozzle heads and each of the other groups comprises at least two nozzle heads, the nozzle heads of all the groups being staggered in at least three lines perpendicular to the main scanning direction, such that the lines mutually overlap in the subscanning direction.

* * * * *